United States Patent [19]

Willis

[11] Patent Number: 4,477,059

[45] Date of Patent: Oct. 16, 1984

[54] FENCE

[76] Inventor: Kenneth R. Willis, Star Rte., Box 85, Eagletown, Okla. 74734

[21] Appl. No.: 393,541

[22] Filed: Jun. 30, 1982

[51] Int. Cl.[3] ..... E04H 17/14

[52] U.S. Cl. ..... 256/65; 403/292; 256/59

[58] Field of Search ..... 403/347, 292; 256/65, 256/66, 72, 59

[56] References Cited

U.S. PATENT DOCUMENTS

| | | | |
|---|---|---|---|
| 3,787,033 | 1/1974 | Snyder et al. | 256/65 X |
| 4,128,356 | 12/1978 | Carlisle | 403/292 |

FOREIGN PATENT DOCUMENTS

| | | | |
|---|---|---|---|
| 393697 | 6/1933 | United Kingdom | 256/65 |
| 960290 | 6/1964 | United Kingdom | 256/59 |
| 1160275 | 8/1969 | United Kingdom | 256/59 |
| 1255724 | 12/1971 | United Kingdom | 256/59 |

*Primary Examiner*—Andrew V. Kundrat

*Attorney, Agent, or Firm*—Wm. T. Wofford; James C. Fails; Arthur F. Zobal

[57] ABSTRACT

A fence formed of hollow fiberglass posts and rails. The posts have apertures formed therethrough transverse to their lengths for receiving the rails. Two hollow rails extend into an aperture from opposite sides of a post with their ends located in the aperture. A hollow connecting member is located within the two hollow rails for connecting together the ends of the two hollow rails. The hollow connecting member has a slit formed through its wall along its length and is compressed such that it may be located within the two hollow rails. The hollow connecting member when located within the two hollow rails expands outward against the walls of the two hollow rails.

11 Claims, 13 Drawing Figures

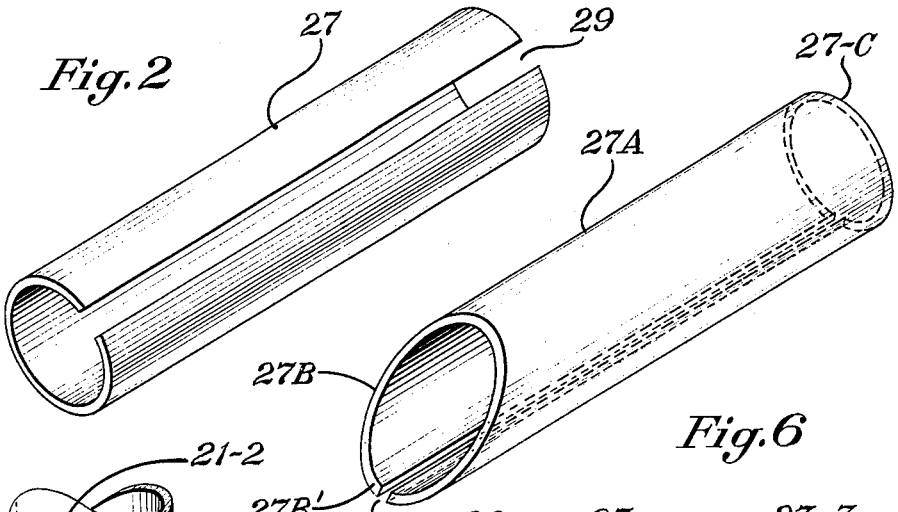
Fig. 2
Fig. 6
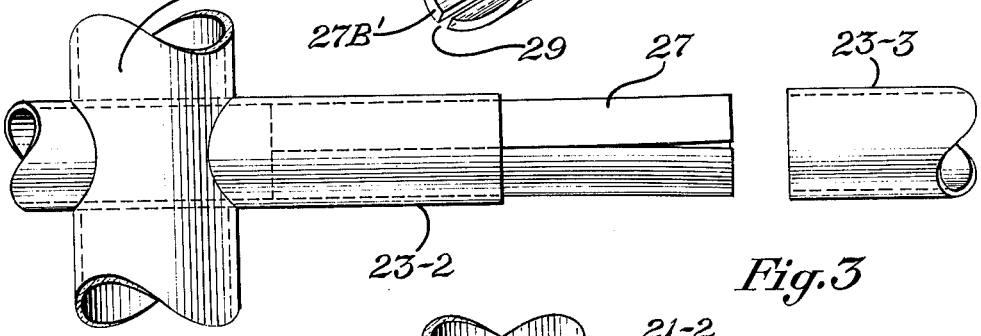
Fig. 3
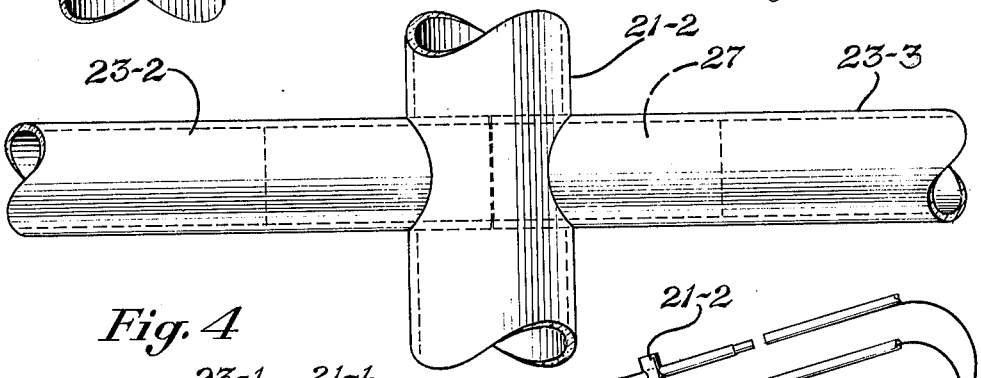
Fig. 4
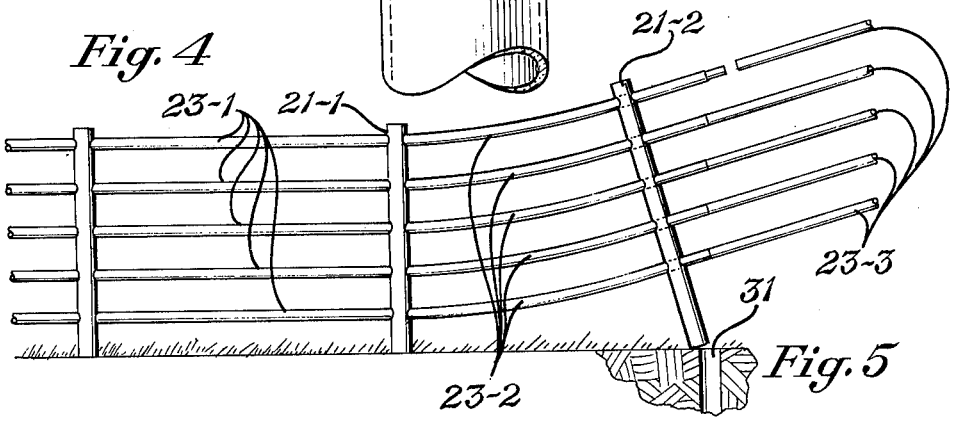
Fig. 5

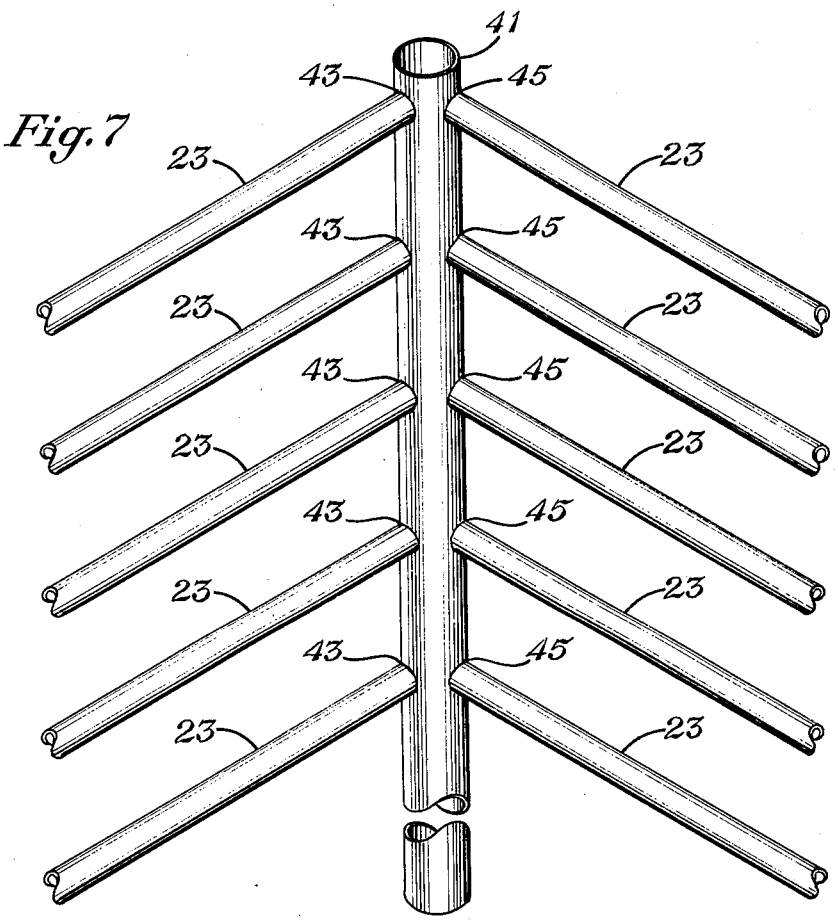
Fig. 7
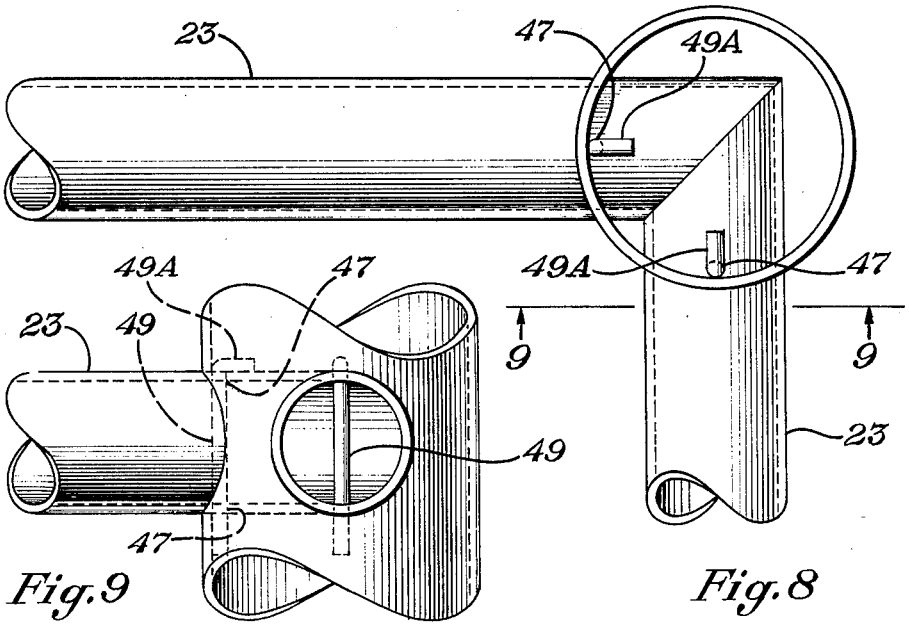
Fig. 9
Fig. 8

Fig.12
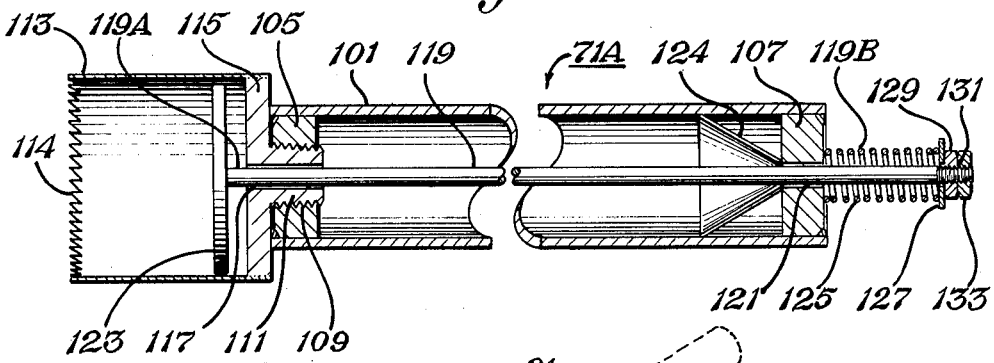
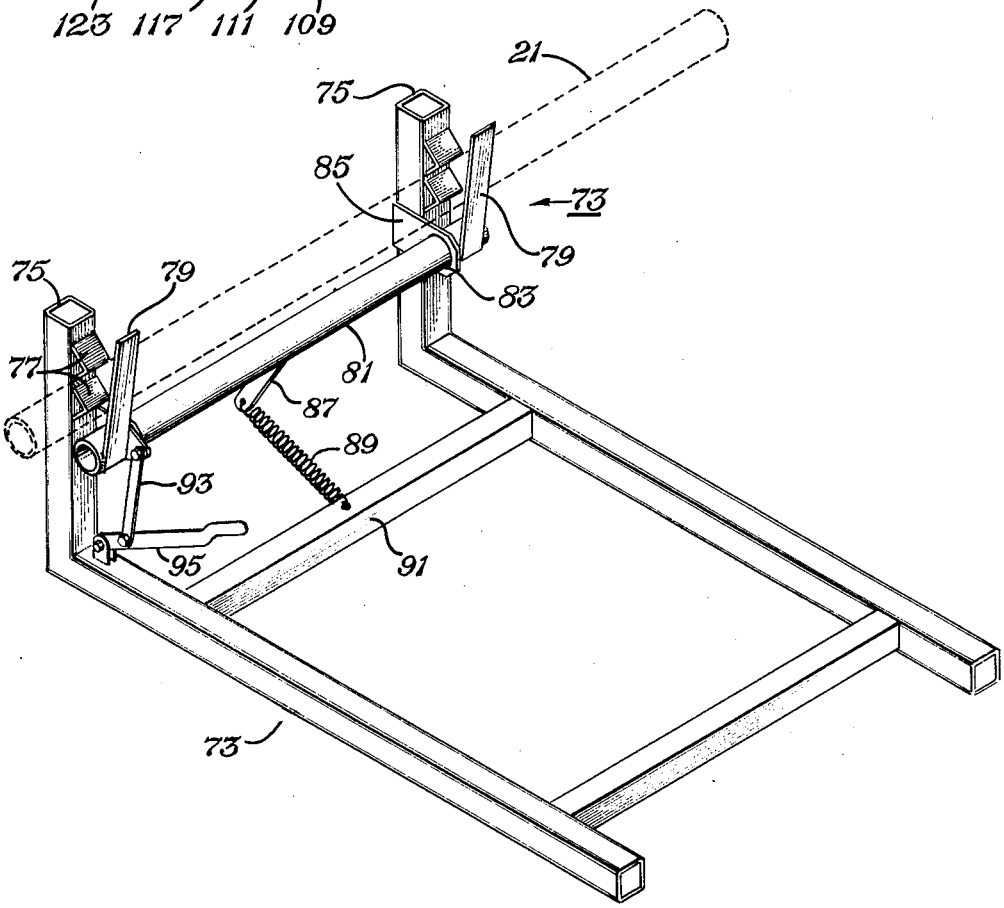
Fig.13

FENCE

SUMMARY OF THE INVENTION

It is an object of the present invention to provide a fence of the type having posts and rails wherein the joints of the rails are hidden from view.

The rails of the fence are hollow and the posts have apertures formed therethrough transverse to their lengths. Two hollow rails extend into an aperture from opposite sides of a post with their ends located in the aperture. A connecting member is located within the two hollow rails for connecting together the ends of the two hollow rails.

In a further aspect, the connecting member is hollow and has a slit formed through its wall along its length. The outside diameter of the connecting member is greater than the inside diameters of the rails. The slit allows the connecting member to be compressed such that it may be located within the two hollow rails. The hollow connecting member when located within the two hollow rails expands outward against the walls of the two hollow rails.

BRIEF DESCRIPTION OF THE DRAWINGS

FIG. 2 is a hollow connecting member used to connect together two rails of the fence.

FIG. 3 illustrates two rails of the fence being connected together with the connecting member of FIG. 2.

FIG. 4 illustrates two rails of the fence connected together with the connecting member of FIG. 2.

FIG. 5 illustrates the fence of FIG. 1 being assembled.

FIG. 6 is another embodiment of a hollow connecting member.

FIG. 7 illustrates rails connected to a corner post.

FIG. 8 is an enlarged top view of FIG. 7.

FIG. 9 is a cross-section of FIG. 8 taken along the lines 9—9 thereof.

FIG. 12 is a cross-section of one of the drilling devices of FIG. 10.

FIG. 13 is a jig employed in the apparatus of FIG. 10 for holding a pipe while holes are being drilled therein.

DESCRIPTION OF THE PREFERRED EMBODIMENTS

Figure 1:
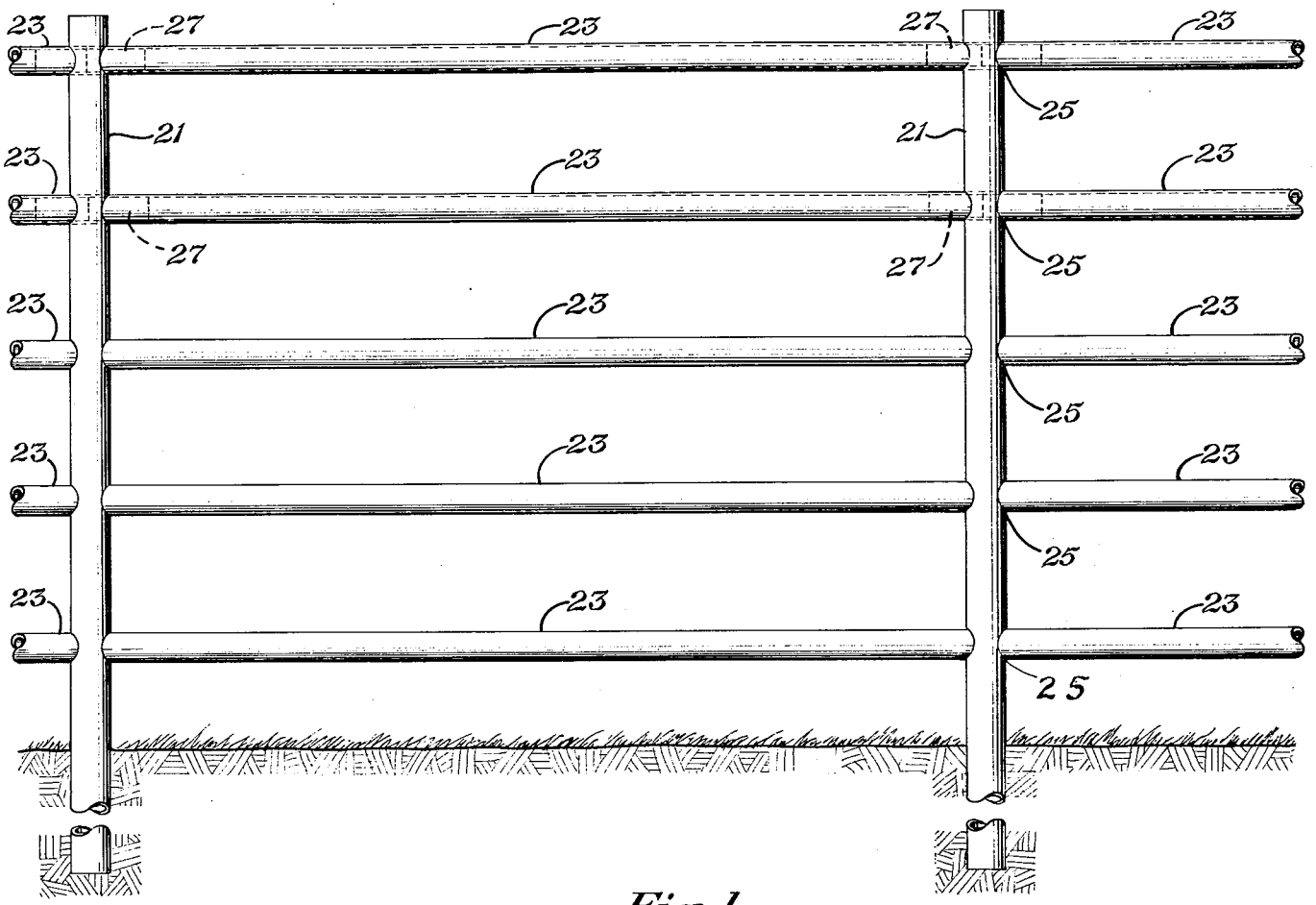
FIG. 1 is a section of the fence of the present invention.

Referring now to FIGS. 1–5 the fence of the present invention is formed of hollow posts 21 and hollow rails 23. Preferably the posts 21 and rails 23 are formed of fiberglass although other suitable plastics or material may be employed. The posts 21 have apertures 25 formed therethrough, transverse to the length of the posts, for receiving the rails. The ends of abutting rails 23 are located in the apertures 25 whereby the joints of the rails 23 are hidden from sight.

Hollow connecting members 27 are located in the rails at their joints for securing the rails together. The rails 23 and connecting members 27 are cylindrical in shape and have the same outside diameters. As seen in FIG. 2, a slit 29 is formed through the wall of the connecting member 27 along its length. The slit 29 has a width sufficient such that the connecting member 27 may be compressed and inserted into the ends 23 of the rails to be abutted. When located within the ends of abutting rails, the connecting member 27 expands against the walls of abutting rails to connect or splice them together.

Referring to FIGS. 3–5, there will be described the manner in which a fence is assembled. In this description, rails 23-1 and 23-2 have their ends inserted and secured in the apertures 25 of post 21-1 which has its bottom end located in a hole in the ground. At this point it is desired to insert and secure the free ends of rails 23-2 and the ends of rails 23-3 in the apertures 25 of post 21-2 and to locate the bottom end of the post 21-2 in the hole 31 formed in the ground. The free ends of rails 23-2 are inserted through the apertures 25 of post 21-2 such that their ends extend beyond the post as shown in FIG. 5. The rails 23-2 are flexible such that they may be bent in the manner shown in FIG. 5 during this portion of the assemblying process. The ends of the connecting members 27 are compressed and inserted into the ends of the rails 23-2 protruding from the post 21-2. The connecting members 27 are inserted into the protruding ends of the rails 23-2 such that half of their lengths are located in the rails 23-2 and half of their lengths extend beyond the protruding ends of the rails 23-2. A hammer may be employed to apply force to the free ends of the connecting members 27 during this inserting process. The free ends of the connecting members are compressed and inserted into the ends of the next rails 23-3. A hammer may be employed to apply force to the free ends of rails 23-3 to cause the ends of rails 23-2 and 23-3 to abut with the abutting ends being connected together with the connecting members 27. The post 21-2 then is slid along rails 23-2 (to the right as seen in FIG. 2) to locate the joints between rails 23-2 and 23-3 within the apertures 25 of the post 21-2 such that the joints cannot be seen. Since the connecting members are within the rails 23-2 and 23-3, they also cannot be seen. The bottom end of the post 21-2 then is lowered into the hole 31 and any space between the post 21-2 and the wall of the hole 31 is filled with dirt.

FIG. 6 illustrates a modified connecting member 27A which has one end 27B cut such that it forms an acute angle relative to the slit 29. This angle may be 45°. The connecting member 27A has advantages in that when the slanted end 27B is inserted into a rail, the point 27B[1] will go in first. As the member 27A is forced further into the rail, the end of the member 27A is compressed closing the gap or slit 29. Thus pre-compression of the end 27B of the connecting member 27A is not required for inserting the end 27B of the member 27A into a rail 23 and insertion is easier. The opposite end 27C, however, will be required to be compressed before inserting it into a rail 23.

Referring to FIGS. 7–9, there is illustrated a hollow corner post 41 having apertures 43 and 45 formed through its wall at right angles relative to each other for receiving the ends of the rails 23. The ends of the rails in the post 41 are cut at 45° whereby they abut each other as shown in FIG. 8. Small vertical apertures 47 are preformed through the walls of the rails 23 at positions such that they will be located near the inside wall of the post 41 and small L-shaped rods 49 are inserted through the apertures 47 with the shorter bent portions 49A of the rods 49 resting on the top sides of the rails. The rods 49 prevent the rails 23 from being removed from the post 41. Insertion of the rods 49 in the apertures 47 of the lower rails 23 may be carried out with special equipment. Attachment of the rails 23 to the post 41 will begin with the lowest rail and progress upward. If the post 41 is used as an end post rather than as a corner post, only one set of apertures 43 or 45 will be formed through its wall for receiving the ends of rails 23 which will be attached to the end post by inserting the rods 49 into the small apertures 47.

After the fence has been assembled and the posts secured in the ground, the tops of the posts may be filled with cement or other material to add to their appearance and to prevent water from entering the posts.

In one embodiment, the rails 23 and connecting members 27 and 27A may have outside diameters of 2 inches. The apertures formed in the posts for receiving the rails will be slightly greater than 2 inches. The posts 21 may have outside diameters of 3 inches and the posts 41 may have outside diameters of 4 inches. The connecting members 27 and 27A may have lengths of 12 inches each. The width of the slit 29 may be about one inch. Although the fence shown has five levels of rails, it is to be understood that the number of levels of rails may be more or less than five.

Referring now to FIGS. 10–13 there will be described the apparatus for forming the apertures 25 through the posts 21 and the apertures 43 and/or 45 into the posts 41. The apparatus comprises a frame 51 for supporting a carriage 53. The carriage has wheels 55 which roll on rails 57 secured to the top sides of the frame 51. A crank 59 having a gear 61 is secured to the frame 51. The teeth of the gear 61 mesh with the teeth of a rack 63 secured to the carriage 53. The carriage may be moved forward or backward by turning the crank 59 in the appropriate direction.

The carriage carries one or more drilling devices 71A–71E employed for drilling one or more holes in a post held at the forward end of the frame 51 in a jig 73 secured to the frame 51. The carriage 53 is capable of supporting a plurality of the devices 71A–71E for forming a plurality of apertures simultaneously in a post. The front end of the jig comprises two vertical members 75 to each of which are secured two angle iron members 77 which form two aligned V-shaped spaces for receiving the post. A post is held in the V-shaped spaces against the angle iron members 77 by clamps 79 to allow the appropriate apertures to be drilled into the post by the devices 71A–71E secured to the carriage 53. The clamps 79 are welded to a pipe 81 adapted to turn in apertures 83 formed in brackets 85 secured to vertical members 75. A rod 87 is secured to pipe 81 and a spring 89 is connected to the end of the rod 87 and to a cross beam 91 of the frame of the jig 73. The spring 89 causes the clamps 79 to be urged against the post for holding it against the angle iron members 75. A linkage 93 is pivotally connected to the pipe 81 and to a lever 95 which also is pivotally connected to the lower frame of the jig. When the lever 95 is moved downward, the clamps 79 are moved away from the angle iron members 77.

Figure 11:
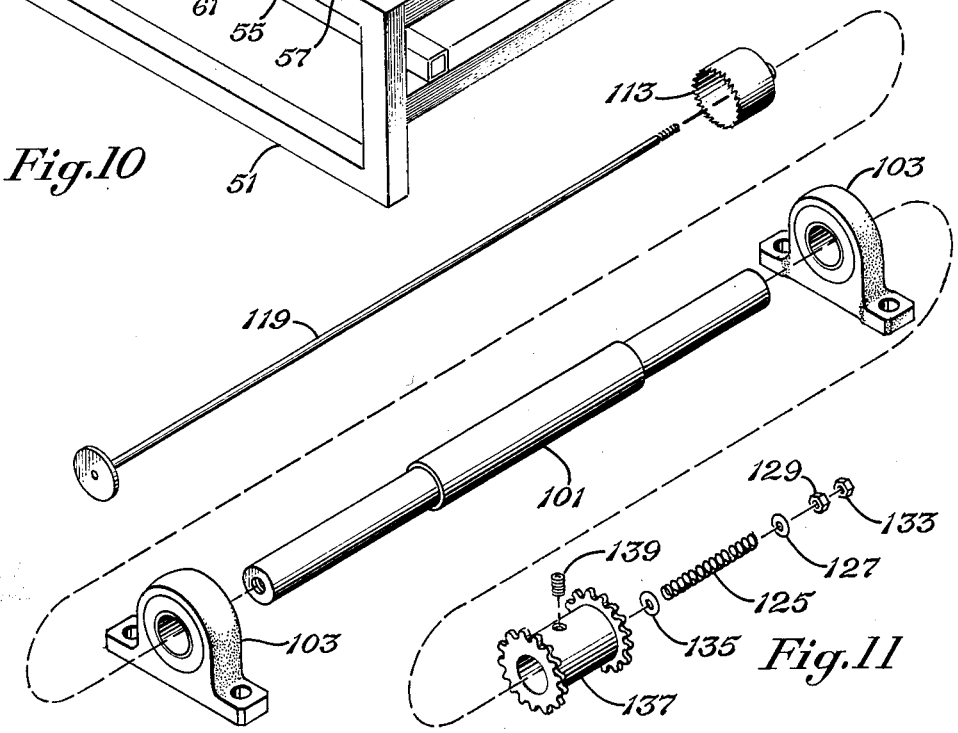
FIG. 11 is an exploded view of one of the drilling devices of FIG. 10.

Referring to FIGS. 11 and 12, each of the devices 71A–71E is the same and comprises a hollow shank 101 having its ends supported for rotation by bearings 103 secured to the carriage 53. End members 105 and 107 are welded in opposite ends of the shank 101. End member 105 has a threaded aperture 109 formed therethrough for receiving a threaded nipple 111 of a hollow cylindrical saw member or hole saw 113 having saw teeth 114 at its forward end. The same member 113 is secured to a rear wall 115 to which the nipple 111 is secured. The saw member 113 is attached to the shank 101 by screwing the nipple 111 into the threaded aperture 109.

The rear wall 115 of the saw member 113 and the nipple 111 have an aperture 117 formed therethrough for freely receiving a plunger 119. End member 107 also has an aperture 121 formed therethrough for freely receiving the plunger. A thin disc shaped member 123 is attached to the forward end 119A of the plunger 119. The plunger 119 is inserted through apertures 117 and 121 such that its rear end 119 projects rearward beyond end member 107 and the disc member 123 is located within the hollow cyclindrical shaped saw member 113. A funnel shaped member 124 has its small end attached to end member 107 to facilitate insertion of the plunger through aperture 121. A spring 125 is located around the rear end 119B of the plunger and has one end seated against the rear end member 107 and its other end seated against a washer 127 which seats against nut 129 which is screwed onto threads 131 formed on the end 119B of the plunger. Nut 133 is screwed onto threads 131 to lock the nut 129 in place. If desired a washer 135 may be provided between the rear end wall 107 and the end of the spring 125 as shown in FIG. 11. The spring 125 normally urges the plunger 119 rearward with the disc 123 against the rear wall 115 of the saw member 113.

The purpose of the plunger 119 and disc 123 is to remove the core or cores from the inside of the cylindrical saw member 113 resulting from an aperture being drilled through one or both walls of a post. Removal of the core or cores is accomplished by pushing the plunger forward to cause the disc 123 to push the core or cores out from the inside of the cylindrical saw member 113. A hammer may be employed to apply force to the rear end of the plunger to force the core or cores out of the cylindrical saw members 113. The spring 113 then moves the plunger 119 rearward to the position shown in FIG. 12.

Figure 10:
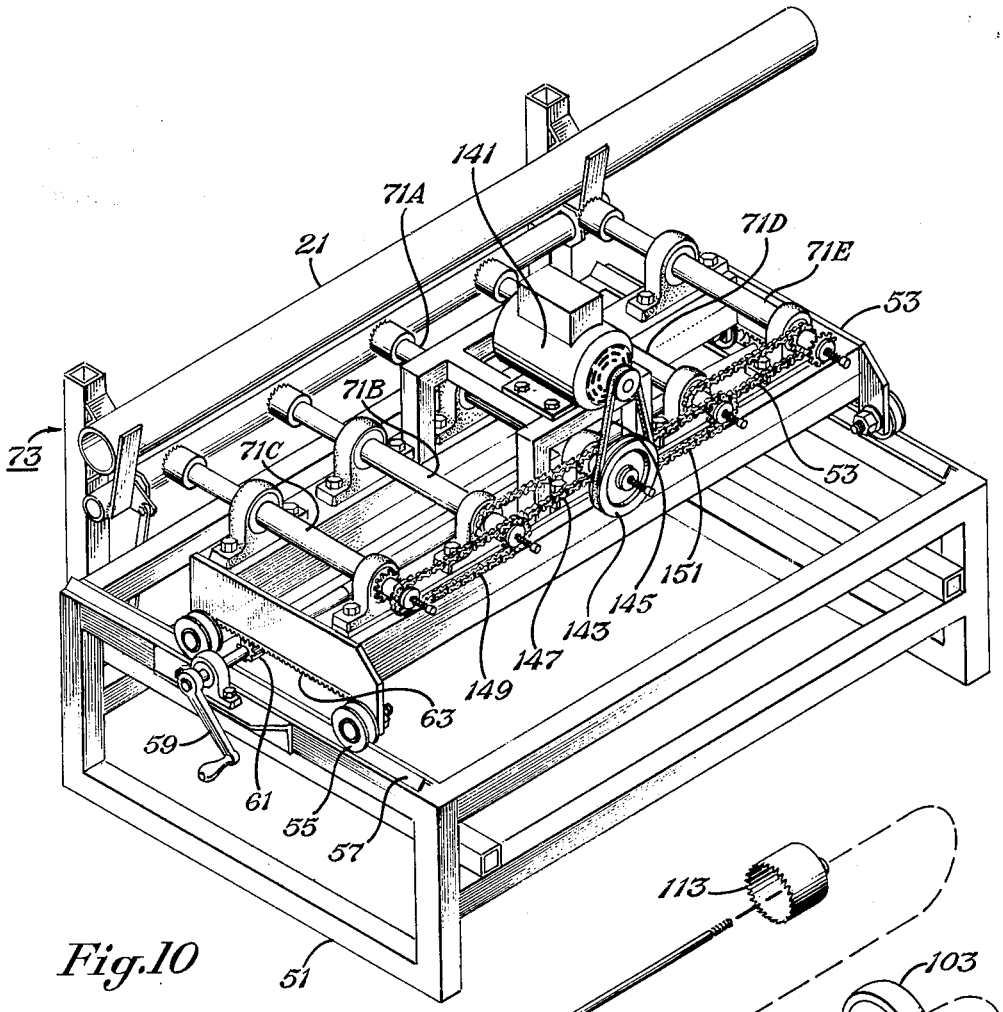
FIG. 10 is an apparatus employed for drilling holes in a fence post.

A system is provided for rotating one or a plurality of the shanks of the drilling devices 71A–71E. The system includes a dual tooth sprocket 137 secured to the rear end of the shank 101 of each device 71A–71E by a set screw 139. An electric motor 141 is mounted to the carriage 51 for driving a pulley 143 attached to the shank 101 of the middle device 71A as shown in FIG. 10. The motor 141 drives the pulley by way of a belt 145. A chain 147 is secured around the inward sprocket teeth of the center device 71A and the next device 71B to the left. A chain 149 is secured around the outer sprocket teeth of the device 71B and the outer device 71C on the left. A chain 151 is secured around the outer sprocket teeth of the center device 71A and the next device 71D to the right. A chain 153 is secured around the inner sprocket teeth of the device 71D and the outer device 71E on the right. Thus rotation of the motor causes all of the shanks 101 and hence all of the cylindrical saw members 113 to be rotated simultaneously. The crank 59 then is turned to move the carriage forward to drill all of the holes simultaneously in the post. The crank 59 next is turned in an opposite direction to back the saw members 113 out of the apertures formed in the post. The motor is turned off and the plungers 119 are moved forward to push the cores out of the saw members 113. If less than five holes are to be drilled into a post, the shanks 101 not needed may be removed beginning with the outer shanks.

Different size saw members 113 may be screwed to the shanks 101 to drill different size apertures in the posts.

In another embodiment of the device of FIG. 12, the aperture 109 may be a smooth surface smaller aperture formed through end member 105 for freely receiving the plunger 119. the nipple 111 may be fixedly attached to the forward end of the end member 105. The rear wall 115 of the saw member may have a threaded aperture formed therethrough for receiving the nipple 111 whereby the saw member 113 may be screwed onto the nipple 111 for attaching the saw member 113 to the shank 101.

I claim:

1. A fence comprising:

a post having an aperture formed therethrough transverse to its length, two hollow rails extending into said aperture from opposite sides of said post with their ends located in said aperture, and a hollow connecting member located within said two hollow rails for connecting together said two ends of said two hollow rails, said connecting member having a slit formed through its wall along its length such that said connecting member may be compressed to be located within said two hollow rails, said connecting member when located within said two hollow rails expanding outward against the walls of said two hollow rails.

2. The fence of claim 1, wherein:

at least one end of said connecting member forms an acute angle relative to the length of said slit.

3. A method of installing a fence of the type having a post with an aperture formed therethrough transverse to its length, comprising the steps of:

providing two hollow rails having ends adapted to fit into the aperture from opposite sides of the post, inserting an end of one of said rails through the aperture of the post, locating a connecting member within said two hollow rails for connecting together the two ends of said two hollow rails, moving the post to a position relative to said two rails such that the two ends of said two connecting rails are located within said aperture of said post, and locating an end of said post into an aperture formed in the earth.

4. The method of claim 3, wherein:

said connecting member being hollow and having a slit formed through its wall along its length such that said connecting member may be compressed to be located within said two hollow rails, said connecting member when located within said two hollow rails, expanding outward against the walls of said two hollow rails.

5. The method of claim 4, wherein:

at least one end of said connecting member forms an acute angle relative to the length of said slit.

6. The method of claim 3, wherein:

said two hollow rails are cylindrical in shape and generally have the same diameters, said connecting member being cylindrical in shape and having an outside diameter greater than that of said two cylindrical shaped rails, said connecting member being hollow and having a slit formed through its wall along its length such that said connecting member may be compressed to be located within said two hollow rails, said connecting member when located within said two hollow rails, expanding outward against the walls of said two hollow rails.

7. The method of claim 6, wherein:

at least one end of said connecting member forms an acute angle relative to the length of said slit.

8. A fence, comprising:

a plurality of spaced apart hollow posts supported in the earth, each of said plurality of posts being round in cross-section and formed of fiberglass, each post having at least one hole formed therethrough, a rail extending through said holes formed through said posts, said rail comprising a plurality of hollow rail members round in cross-section and formed of fiberglass, adjacent hollow rail members of said rail being secured together by a connecting member located within the ends of said adjacent hollow rail members, each of said connecting members being hollow, each of said connecting members having a slit formed through its wall along its length such that each of said connecting members may be compressed to be located within adjacent hollow rail members, each of said connecting members when located within adjacent hollow rail members expanding outward against the walls of said adjacent hollow rail members.

9. A fence comprising:

a post having an aperture formed therethrough transverse to its length, two hollow rails extending into said aperture from opposite sides of said post with their ends located in said aperture, and a connecting member located within said two hollow rails for connecting together said two ends of said two hollow rails, said two hollow rails being cylindrical in shape and generally having the same diameters, said connecting member being cylindrical in shape and having an outside diameter greater than that of said two cylindrical shaped rails, said connecting member being hollow and having a slit formed through its wall along its length such that said connecting member may be compressed to be located within said two hollow rails, said connecting member when located within said two hollow rails expanding outward against the walls of said two hollow rails.

10. The fence of claim 9, wherein:

at least one end of said connecting member forms an acute angle relative to the length of said slit.

11. A fence, comprising:

a plurality of spaced apart hollow posts supported in the earth, each of said plurality of posts being round in cross-section and formed of fiberglass, each post having at least one hole formed therethrough, a rail extending through said holes formed through said posts, said rail comprising a plurality of hollow rail members round in cross-section and formed of fiberglass, adjacent hollow rail members of said rail being secured together by a connecting member located within the ends of said adjacent hollow rail members, said hollow rail members being cylindrical in shape and generally having the same diameters, said connecting members being cylindrical in shape and having outside diameters greater than that of said hollow rail members, each of said connecting members being hollow and having a slit formed through its wall along its length such that each of said connecting members may be compressed to be located within adjacent hollow rail members, each of said connecting members when located within adjacent hollow rail members expanding outward against the walls of said adjacent hollow rail members.

* * * * *